US010864424B2

(12) United States Patent
Amsalem et al.

(10) Patent No.: US 10,864,424 B2
(45) Date of Patent: Dec. 15, 2020

(54) APPARATUS, SYSTEM AND METHOD FOR TRAINING SOCCER PLAYERS

(71) Applicants: Yaakov Amsalem, Zichron Yaakov (IL); Leandro Moncarz, Zichron Yaakov (IL)

(72) Inventors: Yaakov Amsalem, Zichron Yaakov (IL); Leandro Moncarz, Zichron Yaakov (IL)

( * ) Notice: Subject to any disclaimer, the term of this patent is extended or adjusted under 35 U.S.C. 154(b) by 43 days.

(21) Appl. No.: 16/316,824

(22) PCT Filed: Jul. 6, 2017

(86) PCT No.: PCT/IL2017/050760
§ 371 (c)(1),
(2) Date: Jan. 10, 2019

(87) PCT Pub. No.: WO2018/011784
PCT Pub. Date: Jan. 18, 2018

(65) Prior Publication Data

US 2019/0290988 A1 Sep. 26, 2019

(30) Foreign Application Priority Data

Jul. 10, 2016 (IL) ..... 246686
Jul. 10, 2016 (IL) ..... 246688

(51) Int. Cl.
*A63B 69/00* (2006.01)
*A63B 24/00* (2006.01)
(Continued)

(52) U.S. Cl.
CPC ..... *A63B 69/0097* (2013.01); *A63B 24/0006* (2013.01); *A63B 24/0021* (2013.01);
(Continued)

(58) Field of Classification Search
CPC . A63B 24/0021; A63B 24/0062; A63B 63/00; A63B 69/00; A63B 71/0686
(Continued)

(56) References Cited

U.S. PATENT DOCUMENTS 7,172,521 B1 2/2007 Novis
2005/0192125 A1 9/2005 Valliquette
(Continued)

FOREIGN PATENT DOCUMENTS

DE 10105320 9/2001
DE 102005024833 11/2006
(Continued)

OTHER PUBLICATIONS

Linnert Translation, All Pages.*
(Continued)

*Primary Examiner* — John E Simms, Jr.
*Assistant Examiner* — Rayshun K Peng
(74) *Attorney, Agent, or Firm* — Pearl Cohen Zedek Latzer Baratz LLP

(57) ABSTRACT

A soccer training system may include one or more rebound units, including: a base; at least one rebound surface and at least one tunnel having a tunnel inlet and a tunnel outlet, the tunnel has a cross section larger than a soccer ball. The shape of the tunnel may be such that when the base is placed on the ground a soccer ball entering the inlet is directed towards the outlet. The system may further include one or more defense player simulation devices, including a stable body to be placed on a field; and at least one adjustable indicator located on the stable body. In operation the at least one adjustable indicator may be configured to provide game instructions to a user. The system may further include a controller configured to: control the at least one adjustable indicator to provide the game instructions to the user.

17 Claims, 9 Drawing Sheets

(51) Int. Cl.
*A63B 71/06* (2006.01)
*A63B 63/00* (2006.01)

(52) U.S. Cl.
CPC ..... *A63B 24/0062* (2013.01); *A63B 63/00* (2013.01); *A63B 69/002* (2013.01); *A63B 71/0686* (2013.01); *A63B 63/004* (2013.01); *A63B 71/0622* (2013.01); *A63B 71/0669* (2013.01); *A63B 2024/0025* (2013.01); *A63B 2024/0028* (2013.01); *A63B 2024/0037* (2013.01); *A63B 2024/0043* (2013.01); *A63B 2024/0068* (2013.01); *A63B 2063/001* (2013.01); *A63B 2063/002* (2013.01); *A63B 2071/0625* (2013.01); *A63B 2071/0675* (2013.01); *A63B 2071/0683* (2013.01); *A63B 2071/0694* (2013.01); *A63B 2210/50* (2013.01); *A63B 2220/13* (2013.01); *A63B 2220/20* (2013.01); *A63B 2220/801* (2013.01); *A63B 2220/805* (2013.01); *A63B 2220/806* (2013.01); *A63B 2225/09* (2013.01); *A63B 2225/50* (2013.01); *A63B 2225/74* (2020.08); *A63B 2243/0025* (2013.01)

(58) Field of Classification Search
USPC ..... 473/431
See application file for complete search history.

(56) References Cited

U.S. PATENT DOCUMENTS

| | | | | |
|---|---|---|---|---|
| 2007/0176368 | A1* | 8/2007 | Lamberti | A63B 69/0097 273/371 |
| 2014/0031147 | A1 | 1/2014 | Pettersen | |
| 2017/0203176 | A1* | 7/2017 | Moros | G09B 19/0038 |

FOREIGN PATENT DOCUMENTS

| | | | | |
|---|---|---|---|---|
| DE | 102005024833 | A1 * | 11/2006 | A63B 69/34 |
| DE | 202007014952 | | 3/2008 | |
| GB | 2487075 | A * | 7/2011 | A63F 9/24 |
| WO | WO 2012093263 | | 7/2012 | |

OTHER PUBLICATIONS

International Search Report of International Patent Application No. PCT/IL2017/050760 dated Oct. 2, 2017.

Exit Toys, "EXIT Kickback football rebounder 124×90cm", retrieved from the internet on Jan. 9, 2019—https://www.exittoys.ie/football/exit-kickback-football-rebounder-124×90cm-43-23-10-00.

* cited by examiner

APPARATUS, SYSTEM AND METHOD FOR TRAINING SOCCER PLAYERS

CROSS-REFERENCE TO RELATED APPLICATIONS

This application is a National Phase Application of PCT International Application No. PCT/IL2017/050760, International Filing Date Jul. 6, 2017, claiming priority of Israeli Patent Application No. 246688, filed Jul. 10, 2016, and Israeli Patent Application No. 246686, filed Jul. 10, 2016, which are hereby incorporated by reference.

BACKGROUND OF THE INVENTION

Soccer is the most popular sport and the most practiced sport on earth. Millions of children and adults practice soccer at least on a weekly basis. Most of the training equipment for training soccer players includes simple cones, strips and markings on the field.

There is a need for more versatile and adjustable, but yet simple for operating, training system that may provide more diverse and interactive training for players.

SUMMARY OF THE INVENTION

Some embodiments of the invention may be related to a rebound unit for soccer training. The rebound unit may include: a base, at least one rebound surface and at least one tunnel having a tunnel inlet and a tunnel outlet, the tunnel has a cross section larger than a soccer ball. In some embodiments, the shape of the tunnel may be such that when the base is placed on the ground a soccer ball entering the inlet is directed towards the outlet. In some embodiments, the tunnel may include an adjustable directing element configured to set the exit direction from the tunnel. In some embodiments, the directing element may be an adjustable rotating wing. In some embodiments, the directing element may have a concaved shape.

In some embodiments, the rebound unit may further include a connector to connect to at least one additional rebound unit. In some embodiments, one or more of the at least one rebound surface may be concaved. In some embodiments, one or more of the at least one rebound surface may be convex. In some embodiments, the rebound unit may further include at least one sensor for detecting a ball engaging the base. In some embodiments, the at least one sensor may be at least one of a list consisting of: a camera, a motion sensor, a volumetric sensor, a piezoelectric sensor, and a Near Field Communication device (NFC).

In some embodiments, the rebound unit may further include a processor in communication with the at least one sensor. In some embodiments, the processor may be configured to: receive from the sensor a first actual location on the rebound unit at which the ball engaged the rebound unit; determine a second required location on the rebound unit at which the ball should engage the rebound unit; and presenting the second required location via a user interface. In some embodiments, the processor may be further be configured to: receive from the sensor a second actual location on the rebound unit at which the ball engaged the rebound unit; calculate user performance level based one the distance between the second required location and the second actual location; and present the calculated performance level via the user interface.

In some embodiments, the rebound unit may further include one or more adjustable indicator to present instructions to a user. In some embodiments, the one or more adjustable indicators are detachably connected to at least one of the inlet, the outlet, and one or more locations on the rebound surface. In some embodiments, the rebound unit may further include at least one panel having an adjustable angle with respect to the rebound surface.

Some aspects of the invention may be directed to a defense player simulation device for soccer training. The defense player simulation device may include a stable body to be placed on a field; and at least one adjustable indicator located on the stable body. In some embodiments, in operation the at least one adjustable indicator is configured to provide game instructions to a user. In some embodiment, the instructions provided by at least one adjustable indicator may include instructions relating to one of: part of shoe to use, which foot to use, and from which side to pass the defense player simulation device. In some embodiments, the at least one adjustable indicator may be detachably connected to the simulation device.

In some embodiments, the defense player simulation device may be shaped as a shoe. In some embodiments, the defense player simulation device may be shaped as a cone with at least one socket for receiving the at least one indicator. In some embodiments, the defense player simulation device may further include at least one connector for connecting at least another simulation device thereto, such that the connector may be configured to allow relative movement of the defense player simulation device with respect to the other simulation device, around the connector.

In some embodiments, the defense player simulation device may further include a controller configured to: receive game instructions; and control the at least one adjustable indicator to provide the game instructions to the user. In some embodiments, the defense player simulation device may further include at least one sensor attached to the stable body, for detecting at least one of: a location of a ball and a location of the user. In some embodiments, the controller may be further configured to: receive a real location of at least one of: the user and the ball; and determine the game instructions based on the received real location.

Some aspects of the invention may be directed to a soccer training system. The soccer training system may include one or more rebound units, including: a base; at least one rebound surface and at least one tunnel having a tunnel inlet and a tunnel outlet, the tunnel has a cross section larger than a soccer ball. In some embodiments, the shape of the tunnel may be such that when the base is placed on the ground a soccer ball entering the inlet is directed towards the outlet. The system may further include one or more defense player simulation devices, including a stable body to be placed on a field; and at least one adjustable indicator located on the stable body. In some embodiments, in operation the at least one adjustable indicator is configured to provide game instructions to a user. The system may further include a controller configured to: control the at least one adjustable indicator to provide the game instructions to the user.

In some embodiments, the system further include at least one sensor for detecting a ball. In some embodiments, the controller may further be configured to: receive a real location of the ball from the sensor; and determine the game instructions based on the received location. In some embodiments, the at least one sensor may be attached to one of the rebound units. In some embodiments, the controller may be further configured to: receive from the sensor an actual location on the rebound unit at which the ball engaged the rebound unit; determine a second required location on the rebound unit at which the ball should engage the rebound unit; and presenting the second required location via at least one of: a user interface and the adjustable indicator.

In some embodiments, at least one sensor may be attached to the at least one of the defense player simulation devices and configured to detect at least one of: the user and the ball. In some embodiments, the controller may be further configured to: receive from the sensor a real location of at least one of: the user and the ball; and determine the game instructions based on the received real location.

In some embodiments, the at least one sensor is selected from a group consisting of: a camera, a motion sensor, a volumetric sensor, a piezoelectric sensor, a Near Field Communication device (NFC).

Some aspects of the invention may include a method of training a soccer player. The method may include: placing on a field one or more defense player simulation devices, each comprising: a stable body to be placed on the field; and at least one adjustable indicator located on the stable body, such that in operation the at least one adjustable indicator is configured to provide game instructions to a user. The method may further include adjusting the at least one adjustable indicator according to the game instructions.

Some aspects of the invention may include a method of controlling a soccer training system. In some embodiments, the method may include receiving a location of at least one of: a ball or a player from at least one sensor located on at least one of: a rebound unit and one or more defense player simulation devices included in the training system; determining game instructions to be provided to the player based on the received location; and adjusting at least one adjustable indicator located on at least one of: the rebound unit and the one or more defense player simulation devices, to provide the game instructions to the player. In some embodiments, the rebound unit may include a base; at least one rebound surface and at least one tunnel having a tunnel inlet and a tunnel outlet, the tunnel has a cross section larger than a soccer ball. In some embodiments, the shape of the tunnel may be such that when the base is placed on the ground a soccer ball entering the inlet is directed towards the outlet. In some embodiments, the one or more defense player simulation devices, may include a stable body to be placed on a field; and at least one adjustable indicator located on the stable body.

Some embodiments of the invention may be directed to a soccer training system. The system may include: one or more rebound units, comprising: a base; and at least one rebound surface. The system may further include one or more defense player simulation devices, comprising: a stable body to be placed on a field; and at least one adjustable indicator located on the stable body, such that in operation the at least one adjustable indicator is configured to provide game instructions to a user. The system may further include a controller that may be configured to: control the at least one adjustable indicator to provide the game instructions to the user.

In some embodiments, the soccer training system may further include: at least one sensor for detecting a ball and the controller may further be configured to: receive a real location of the ball from the sensor; and determine the game instructions based on the received location. In some embodiments, the at least one sensor may be attached to one of the rebound units, and the controller may further be configured to: receive from the sensor an actual location on the rebound unit at which the ball engaged the rebound unit; determine a second required location on the rebound unit at which the ball should engage the rebound unit; and presenting the second required location via at least one of: a user interface and the adjustable indicator.

In some embodiments, at least one sensor may attached to the at least one of the defense player simulation devices and configured to detect at least one of: the user and the ball, and the controller may further be configured to: receive from the sensor a real location of at least one of: the user and the ball; and determine the game instructions based on the received real location. In some embodiments, the at least one sensor is selected from a group consisting of: a camera, a motion sensor, a volumetric sensor, a piezoelectric sensor a Near Field Communication device (NFC).

In some embodiments, the soccer training system may further include: one or more additional adjustable indicators attached to the one or more rebound units, such that in operation the additional one or more adjustable indicators are configured to provide game instructions to a user.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
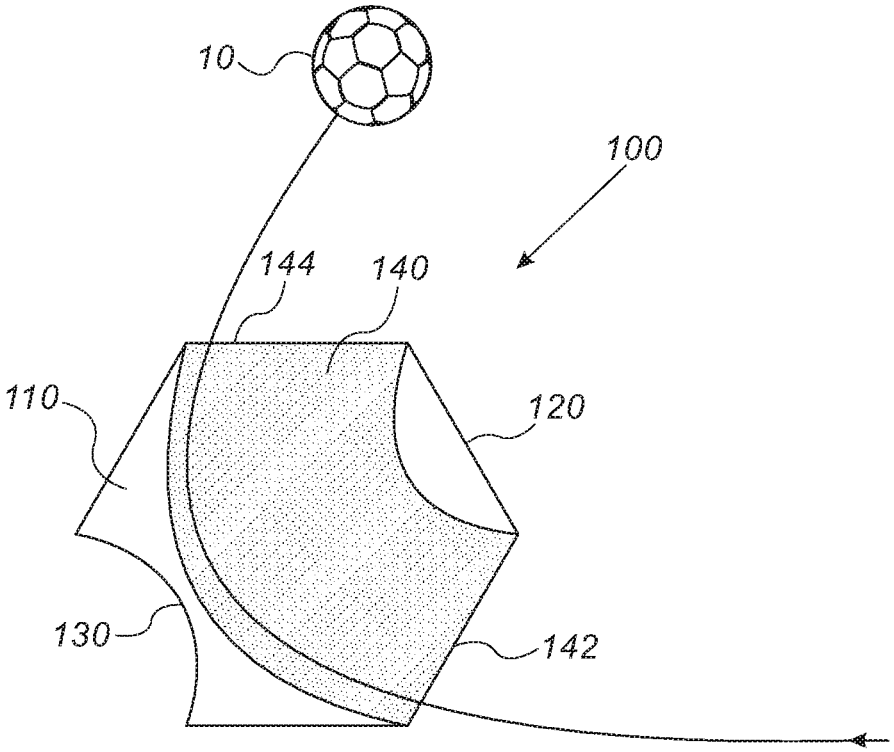
FIGS. 1A-1B are illustrations of a rebound unit according to some embodiments of the invention.

In the following detailed description, numerous specific details are set forth in order to provide a thorough understanding of the invention. However, it will be understood by those skilled in the art that the present invention may be practiced without these specific details. In other instances, well-known methods, procedures, and components, modules, units and/or circuits have not been described in detail so as not to obscure the invention. Some features or elements described with respect to one embodiment may be combined with features or elements described with respect to other embodiments. For the sake of clarity, discussion of same or similar features or elements may not be repeated.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Some aspects of the invention may be directed to a system and devices for training soccer players. The system may include a rebound unit at which a player may direct a ball and receive the ball back from the rebound unit in a predetermined and optionally adjustable angle. The system may further include one or more defense player simulation devices that simulates a defense player to be passed by the player. In some embodiments, each defense player simulation device may include indicator(s) for indicating to the player at least one of: from which side of the device the player should pass, by which foot to kick the ball using which part of the shoe, and the like. In some embodiments, the system may include a controller for controlling adjustable indicators (e.g., signs, signals, marking, etc.) to be included or attached to the one or more defense player simulation devices and/or the rebound unit. The adjustable indicators may be controlled (either by the controller or manually) to provide game instructions to the player. As used herein "game instructions" may include any instructions that may be provided to a user (e.g., a player, a coach, etc.) by indicators such as, marking, signals, signs, lights, sounds, a combination thereof, etc. that are related to a way to play (e.g., indicate to a user what actions to take and when to take them). For example, the "game instructions" may include kicking or otherwise hitting the ball, in order to direct the ball in a certain direction, passing the ball from a certain side of an element placed on the field, which foot to use for kicking the ball, in which part of the shoe to hit, and the like.

In some embodiments, the system may further include one or more sensors (e.g., cameras, movement sensors and the like) for detecting a location of the player and/or the ball on the field. In some embodiments, the controller may be configured to determine the game instructions based on the location of the player and/or the ball received from the sensor, and/or based on a predetermined training plan.

Figure 1B:
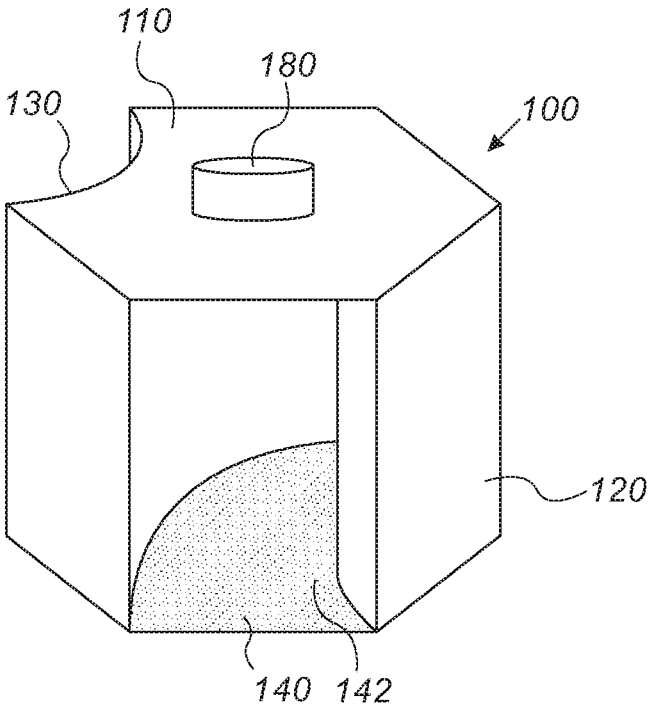

Reference is made to FIGS. 1A and 1B which are illustrations of a top section and an isometric view of a rebound unit for soccer training, respectively, according to some embodiments of the invention. A rebound unit 100 for soccer training may include a base 110, at least one rebound surface(s) 120 and/or 130 and at least one tunnel 140. Tunnel 140 may include a tunnel inlet 142 and a tunnel outlet 144. Tunnel 140 may have a cross section larger than an outer diameter of a soccer ball (e.g., soccer ball 10). In some embodiments, the shape of tunnel 140 may be such that when base 110 is placed on the ground soccer ball 10 entering inlet 142 may be directed towards outlet 144.

In some embodiments, base 110 may be made from any suitable material, for example, polymers such as polyesters, wood, metals or a combination thereof. In some embodiments, base 110 may include an outer shell made from a polymer filled with water or other filling material (e.g., foam, sponge, etc.).

The rebound surface may be any surface of base 110 that may return or otherwise change the direction of movement of ball 10 upon engaging with the rebound surface. In some embodiments, rebound surface 120 may be substantially flat (as illustrated). In some embodiments, the rebound surface may have a shape designed to return the ball at a predetermined direction. For example, rebound surface 120, 130 may be convex (not illustrated) and/or rebound surface 130 may be concaved (as illustrated). In some embodiments, rebound unit 100 may include more than one rebound surfaces, for example, the 4 rebound surfaces illustrated in FIGS. 1A and 1B.

In some embodiments, rebound unit 100 may further include at least one sensor 180 for detecting ball 10 engaging base 110. In some embodiments, sensor 180 may be a camera (e.g., 360° camera), a motion sensor, a volumetric sensor, a piezoelectric sensor, Near Field Communication device (NFC) and the like. One or more sensors 180 may be attached to base 110 at any place required for sensing an engagement of soccer ball 10. In some embodiments, rebound unit 100 may further include or may be in communication with a processor (e.g., a processor 1120 and/or the processor of a mobile device 20 illustrated in FIG. 14). In some embodiments, the processor may be configured to receive from sensor 180 a first actual location on rebound unit 100 at which ball 100 engaged rebound unit 100, for example, a location on rebound surface 120. In some embodiments, the processor may further determine a second required location the rebound unit 100 at which ball 100 should engage rebound unit 100, for example, tunnel inlet 142 (as illustrated) and present the second required location via a user interface, for example, a screen of a mobile device (e.g., mobile device 20, such as, a smartphone, a smartwatch, etc.).

In some embodiments, the processor may further be configured to receive from sensor or sensors 180 a second actual location on rebound unit 100 at which ball 10 engaged rebound unit 100, for example, a corner between inlet 142 and rebound surface 120. In some embodiments, the processor may calculate user performance level based on the distance between the second required location and the second actual location. For example, if the distance is above a predetermined level (e.g., 50 cm) the processor may give the user a low score while if the distance is below another predetermined level (e.g., 10 cm) a high score may be assigned to the user's performance. In some embodiments, the calculated performance level may be presented to the user via the user interface.

Figure 2:
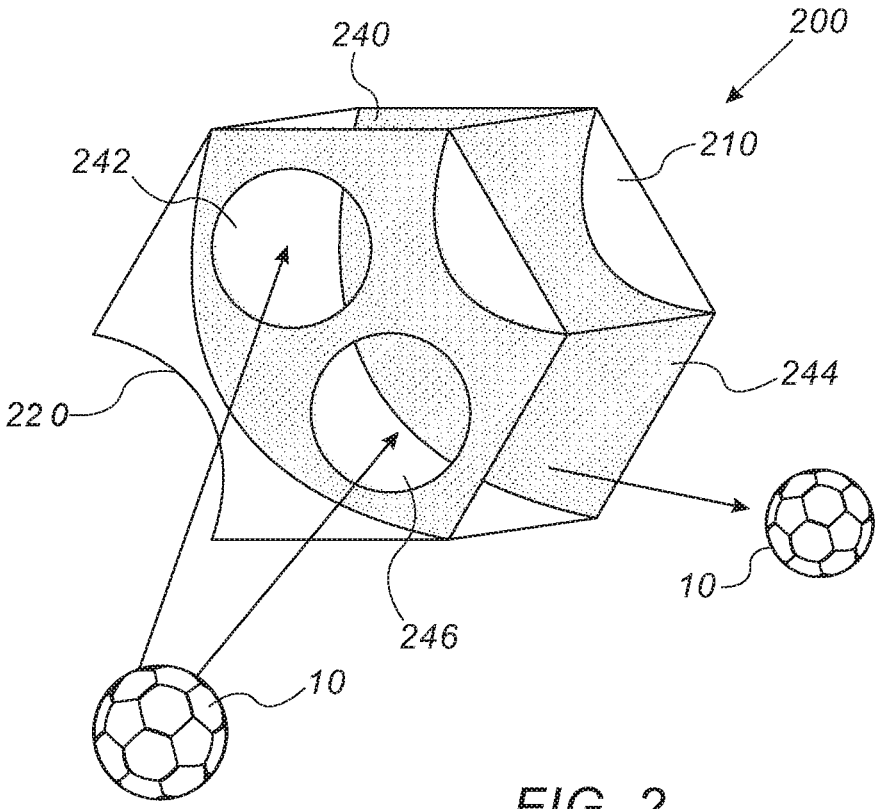
FIG. 2 is an illustration of a rebound unit according to some embodiments of the invention.

Reference is now made to FIG. 2 which is an illustration of a rebound unit for soccer training according to some embodiments of the invention. A rebound unit for soccer training 200 may include a base 200, at least one rebound surface 220 and at least one tunnel 240. Tunnel 240 may include at least two tunnel inlets 242 and 246 and a tunnel outlet 244. Tunnel 240 may have a cross section larger than a soccer ball's outer diameter (e.g., soccer ball 10). In some embodiments, the shape of tunnel 240 may be such that when base 210 is placed on the ground soccer ball 10 entering either inlet 242 or inlet 246 may directed towards outlet 244.

Figure 3A:
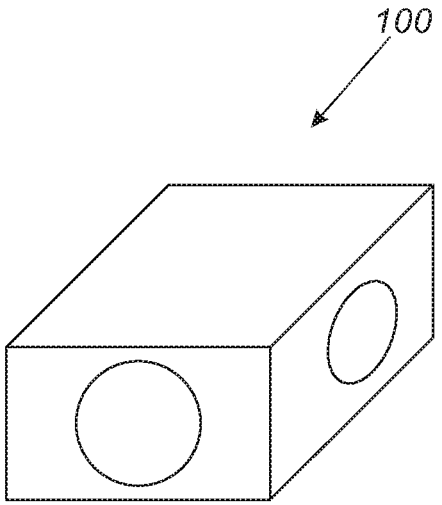
FIGS. 3A and 3B are illustrations of rebound units according to some embodiments of the invention.
Figure 3B:
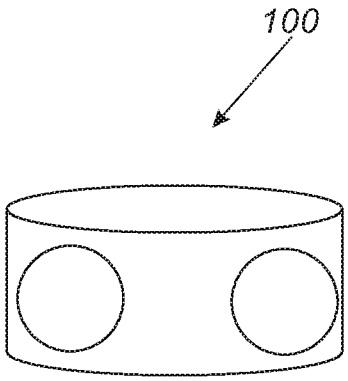

In some embodiments, base 110 of rebound unit 100 may have any geometrical shape as illustrated, for example, in FIGS. 3A and 3B which are illustrations of rebound units according to some embodiments of the invention. Rebound unit 100 of FIG. 3A may have a base in a shape of a cube and rebound unit 100 of FIG. 3B may have a base in a shape of a cylinder.

Figure 4A:
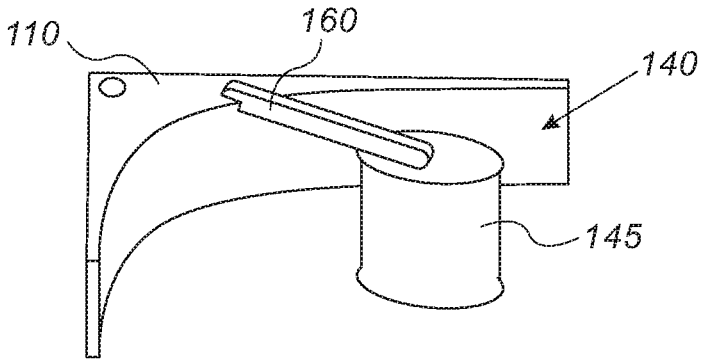
FIGS. 4A and 4B are illustration of a directing element and a connecting element in rebound unit according to some embodiments of the invention.
Figure 4B:
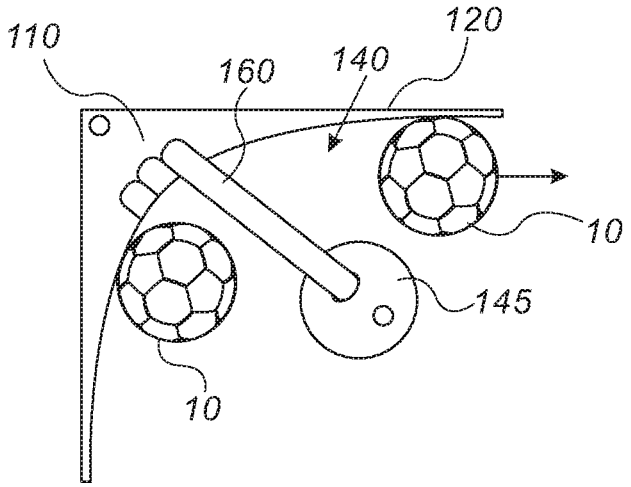
Figure 5:
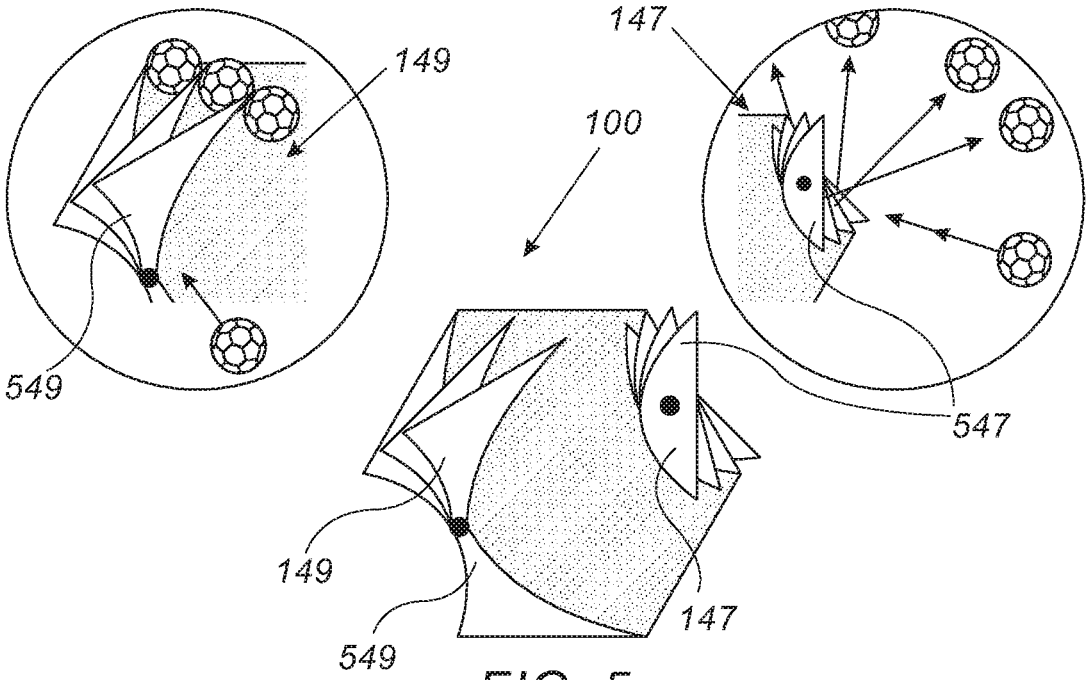
FIG. 5 is an illustration of a directing element in a rebound unit according to some embodiments of the invention.
Figure 6A:
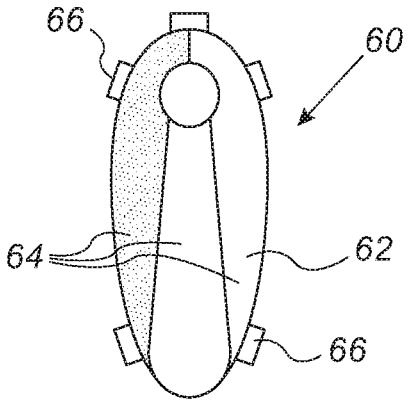
FIGS. 6A and 6B are illustrations of a defense player simulation device for soccer training according to some embodiments of the invention.
Figure 7A:
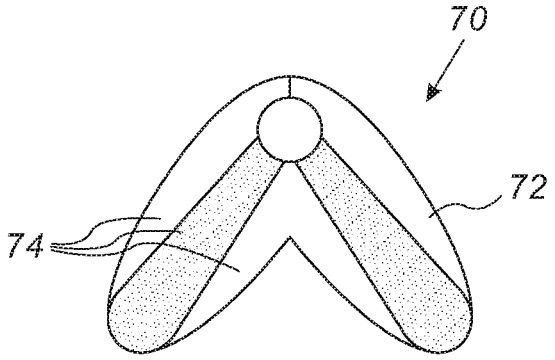
FIGS. 7A and 7B are illustrations of a defense player simulation device for soccer training according to some embodiments of the invention.
Figure 6B:
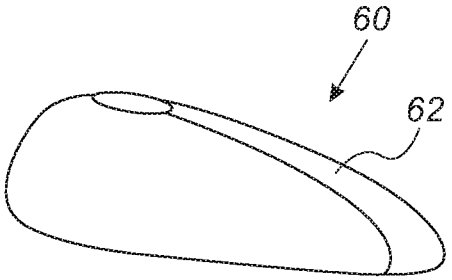
Figure 7B:
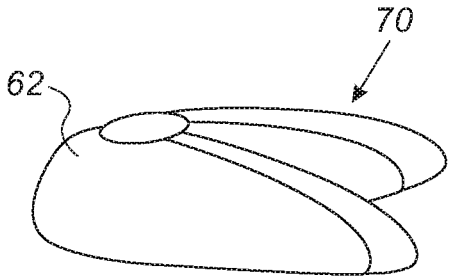
Figure 8A:
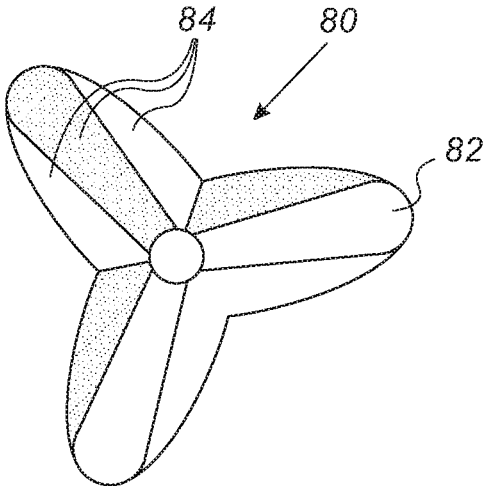
FIGS. 8A and 8B are illustrations of a defense player simulation device for soccer training according to some embodiments of the invention.
Figure 8B:
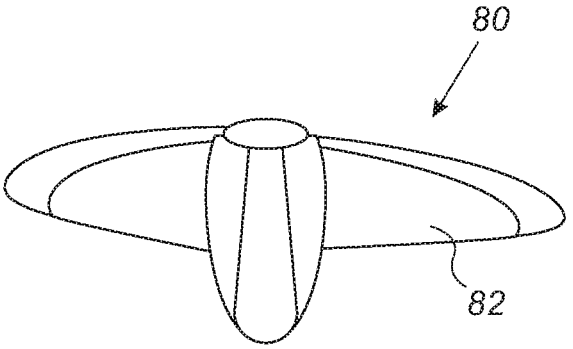

In some embodiments, tunnel 140 may include an adjustable directing element configured to set the exit direction from the tunnel, as illustrated in FIGS. 4A, 4B and 5. In some embodiments, rebound unit 100 may further include a connector for connecting two or more bases 110 into a single rebound unit.

Reference is now made to FIGS. 4A and 4B which are illustrations of a directing element and a connector in a rebound unit according to some embodiments of the invention. Directing element 145 may be located or included in tunnel 140 such that a ball 10 (illustrated in FIG. 4B) entering tunnel 140 may be directed by directing element 145 to exit tunnel 140 at a predetermined exit direction (marked with an arrow). The exit direction may be defined as the direction at which the ball is set to exit tunnel 140, for example, with respect to one of the rebound surfaces. In some embodiments, directing element 145 may have a concaved shape (as illustrated).

In some embodiments, rebound unit 100 may further include a connector 160 to connect at least one additional rebound unit 100. In some embodiments, connector 160 may connect two bases such that a first rebound unit 100 is placed on top of a second rebound unit 100. In some embodiments, connector 160 may connect the first and second rebound units 100 such that a rebound surface of the first rebound unit 100 is attached to a rebound surface of the second rebound unit 100.

Reference is now made to FIG. 5 which is an illustration of directing elements in a rebound unit according to some embodiments of the invention. In some embodiments, the exit direction may be adjustable by adjusting movable components in the directing elements. For example, a directing element 147 located in the tunnel may include one or more adjustable rotating wings 547. Rotating at least one rotating wing 547 may change the exit direction of ball 10 as illustrated in the part (circled) in the right side of FIG. 5. In yet another example, a directing element 149 located in the tunnel may include one or more adjustable rotating wings 549. Rotating at least one rotating wing 549 may change the exit direction of ball 10 as illustrated in the part (circled) in the left side of FIG. 5.

In some embodiments, rebound unit 100 may include at least one panel having an adjustable angle with respect to the rebound surface, (not illustrated). For example, rebound surface 120 may further include a panel connected to an adjustable shaft allowing to change the angle of the panel with respect to rebound surface 120.

In some embodiments, as part of the training of a soccer player, the player may train to pass another player while dribbling the ball. Accordingly, some aspects of the invention may be directed to a defense player simulation device for soccer training. Traditional devices have a shape of cones or cups and are configured to be placed as obstacles on the flied. Any game instruction as how to pass each cone is given verbally by the coach. A defense player simulation device according to some embodiments of the invention may provide the game instructions using one or more adjustable indicators.

Reference is now made to FIGS. 6A-6B, 7A-7B and 8A-8B which are illustrations of a top view and an isometric view of various defense player simulation devices according to some embodiments of the invention. A defense player simulation device 60 of FIGS. 6A-6B may have a shape of a single soccer shoe, a defense player simulation device 70 of FIGS. 7A-7B may have a shape of two soccer shoes merged together and a defense player simulation device 80 of FIGS. 8A-8B may have a shape of three soccer shoes merged together. In some embodiments, each defense player simulation devices 60, 70 and 80 may include a stable base 62, 72 and 82 to be placed on a field and at least one adjustable indicator 64, 74 and 84 located on stable body 62, 72 and 82. In some embodiments, in operation at least one adjustable indicator 64, 74 and 84 may be configured to provide game instructions to a user. For example, adjustable indicators 64, 74 and 84 may include three different sections indicating different portions of a soccer shoe to be used by the player when passing the ball. In operation the user (e.g., the player or the coach) may indicate the required portion by coloring the portion (illustrated as the dark portions in each one of devices 60-80), highlighting the portion (e.g., by lighting a lamp related to the portion) and the like. In some embodiments, the instructions provided by at least one adjustable indicator 64, 74 and 84 may include instructions relating to one of: which part of shoe to use (as illustrated), which foot to use (e.g., by indicating only one shoe portion in device 70), and from which side to pass the defense player simulation device (e.g., by using an arrow illustrated in FIG. 9C).

Figure 11A:
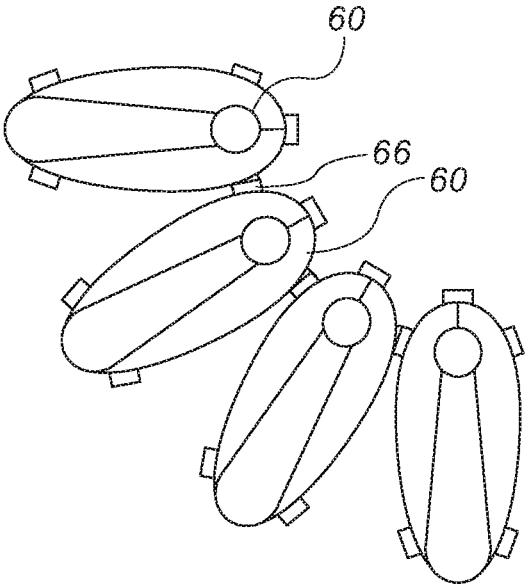
FIGS. 11A and 11B are illustrations of defense player simulation devices for soccer training according to some embodiments of the invention.
Figure 11B:
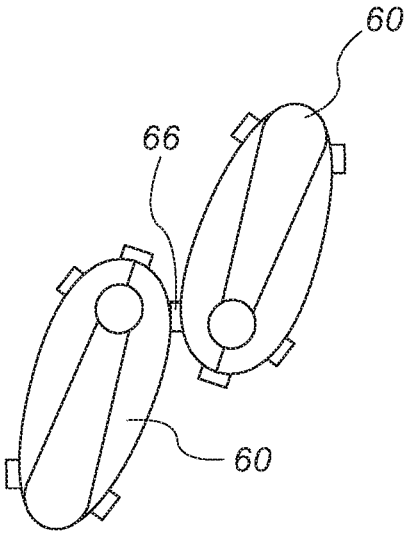

In some embodiments, defense player simulation device 60 may further include connectors 66 for connecting one or more defense player simulation devices as illustrated and discussed with respect to FIGS. 11A and 11B.

Figure 9A:
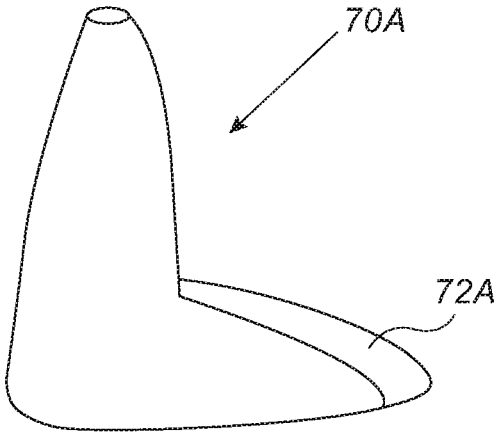
FIGS. 9A-9C are illustrations of defense player simulation devices for soccer training according to some embodiments of the invention.
Figure 9B:
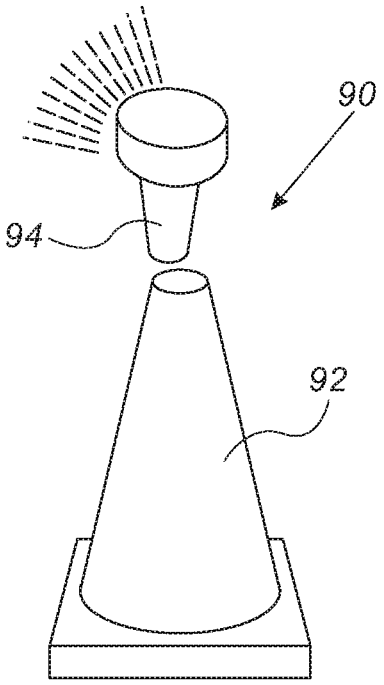
Figure 9C:
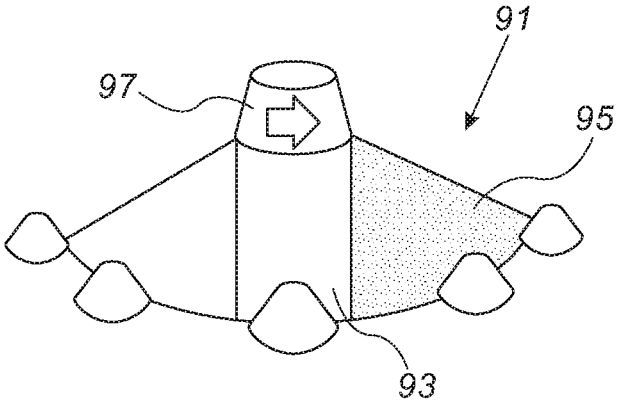

Reference is now made to FIGS. 9A-9C which are illustrations of defense player simulation devices for soccer training according to some embodiments of the invention. A defense player simulation device 70A illustrated in FIG. 9A may have a shape of two soccer shoes merged with a high cone. A defense player simulation device 90 illustrated in FIG. 9B may have stable base 92 in a shape of a cone (e.g., a commercial cone) and an adjustable indicator 94 which may be detachably connected to base 92 of simulation device 90. In some embodiments, adjustable indicator 94 may include at least one lamp or any other light indicator configured to be lighted in order to provide the game instructions.

A defense player simulation device 91 illustrated in FIG. 9C may have stable base 93 in a shape of a cone and two adjustable indicators 95 and 97. Adjustable indicator 95 may be included in base 93 and may be configured to indicate which part of shoe to use. Adjustable indicator 97 may be permanently or detachably connected to base 93 and may include adjustable arrow (e.g., configured to change directions) for indicating which foot to use or from which side to pass device 91.

Figure 10A:
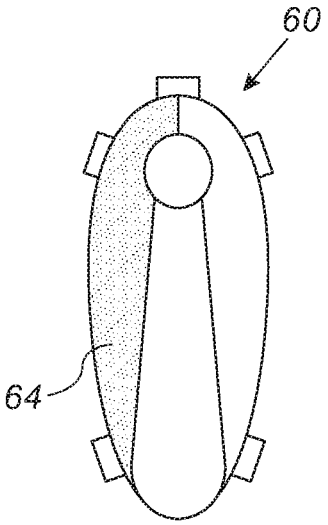
FIGS. 10A-10C are illustrations of a defense player simulation device for soccer training according to some embodiments of the invention.
Figure 10B:
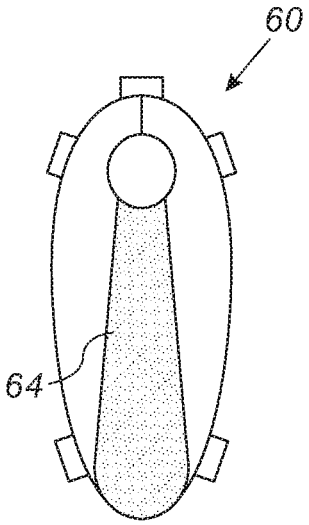
Figure 10C:
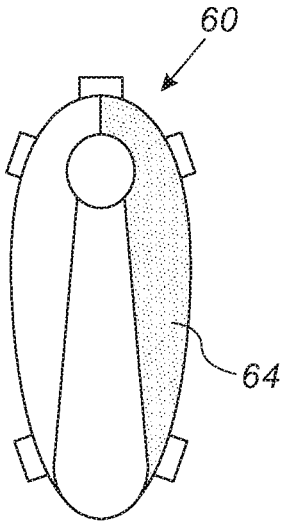

In some embodiments, the instruction which part of the soccer shoe to use may be indicated by coloring, highlighting or otherwise signaling different portions of the defense player simulation device, as illustrated in FIGS. 10A-10C. FIG. 10A is an illustration of defense player simulation device 60 in which an indication for using the left part of the shoe may be provided by changing the colors of the left part of device 60 (e.g., by attaching a colored sticker, lightening the colored part etc.). FIG. 10B is an illustration of defense player simulation device 60 in which an indication for using the central part of the shoe may be provided by coloring the central part of device 60. FIG. 10C is an illustration of defense player simulation device 60 in which indication for using the right part of the shoe may be provided by coloring the right part of device 60.

Reference is now made to FIGS. 11A-11B which are illustrations of defense player simulation devices for soccer training according to some embodiments of the invention. In some embodiments, several defense player simulation devices 60 may be connected to each other. In some embodiments, defense player simulation devices 60 may be connected using one or more connectors 66, for example, the four simulation devices 60 illustrated in FIG. 11A and two simulation devices 60 illustrated in FIG. 11B. In some embodiments, any number of simulation devices 60 may be connected to each other.

Figure 12:
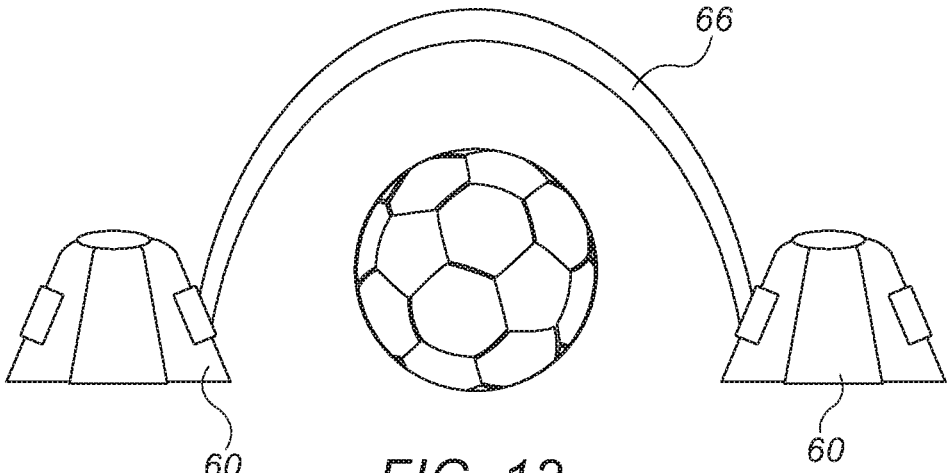
FIG. 12 is an illustration of a defense player simulation device for soccer training according to some embodiments of the invention.

Reference is now made to FIG. 12 which is an illustration of a defense player simulation device for soccer training according to some embodiments of the invention. The device of FIG. 12 may include at least two simulation devices 60 connected together by an arched connector 66 such that a soccer ball may pass between the two connected simulation devices 60.

In some embodiments, both the rebound unit(s) and one or more defense player simulation devices may be included in a soccer training system. In some embodiments, the soccer training system may include a processor configured to control various controllable components of the soccer training system (e.g., adjustable indicators, sensors, user interfaces and the like).

Figure 13:
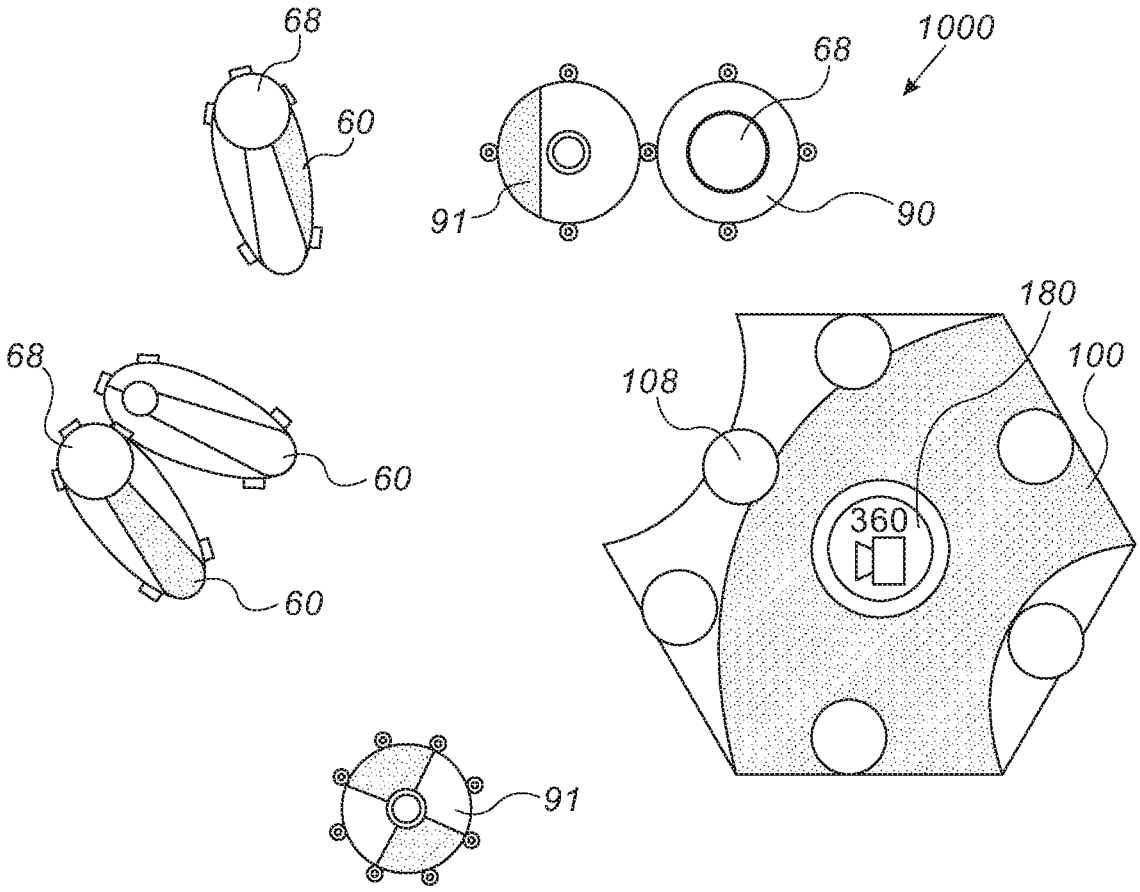
FIG. 13 is an illustration of a soccer training system according to some embodiments of the invention.

Reference is now made to FIG. 13 which is an illustration of a soccer training system 1000 according to some embodiments of the invention. System 1000 may include at least one rebound unit (e.g., rebound unit 100 and 200) and one or more defense player simulation devices (e.g., devices 60, 70, 80, 90 and 91). For example, system 1000 illustrated in FIG. 13 may include rebound unit 100 and six defense player simulation devices: standalone simulation device 60, two simulation devices 60 connected together by connector 66, standalone simulation device 91 and simulation device 91 connected to simulation device 90.

In some embodiments, system 1000 may include at least one rebound unit 100 that may include a base 110 and at least one rebound surface 120. Such system 1000 may include one or more defense player simulation devices (e.g., devices 60, 70, 80, 90 and 91). In some embodiments, system 1000 may further include sensors 68, 108 and 180 for detecting the location of the ball and/or the user. Sensors 68 may be connected to at least one defense player simulation device and one or more sensors 68, 108 and 180 may be located on rebound unit 100 (e.g., a rebound unit that may or may not include a tunnel 140). In some embodiments, sensor 180 may be a camera (e.g., a 360° camera). In some embodiments, one or more adjustable indicators 164 may be included or attached to rebound unit 100, as illustrated and discussed with respect to FIG. 14. In some embodiments, the images and videos captured by the 360° camera may be presented to the user via a user interface, for example, a screen of a mobile device.

Figure 14:
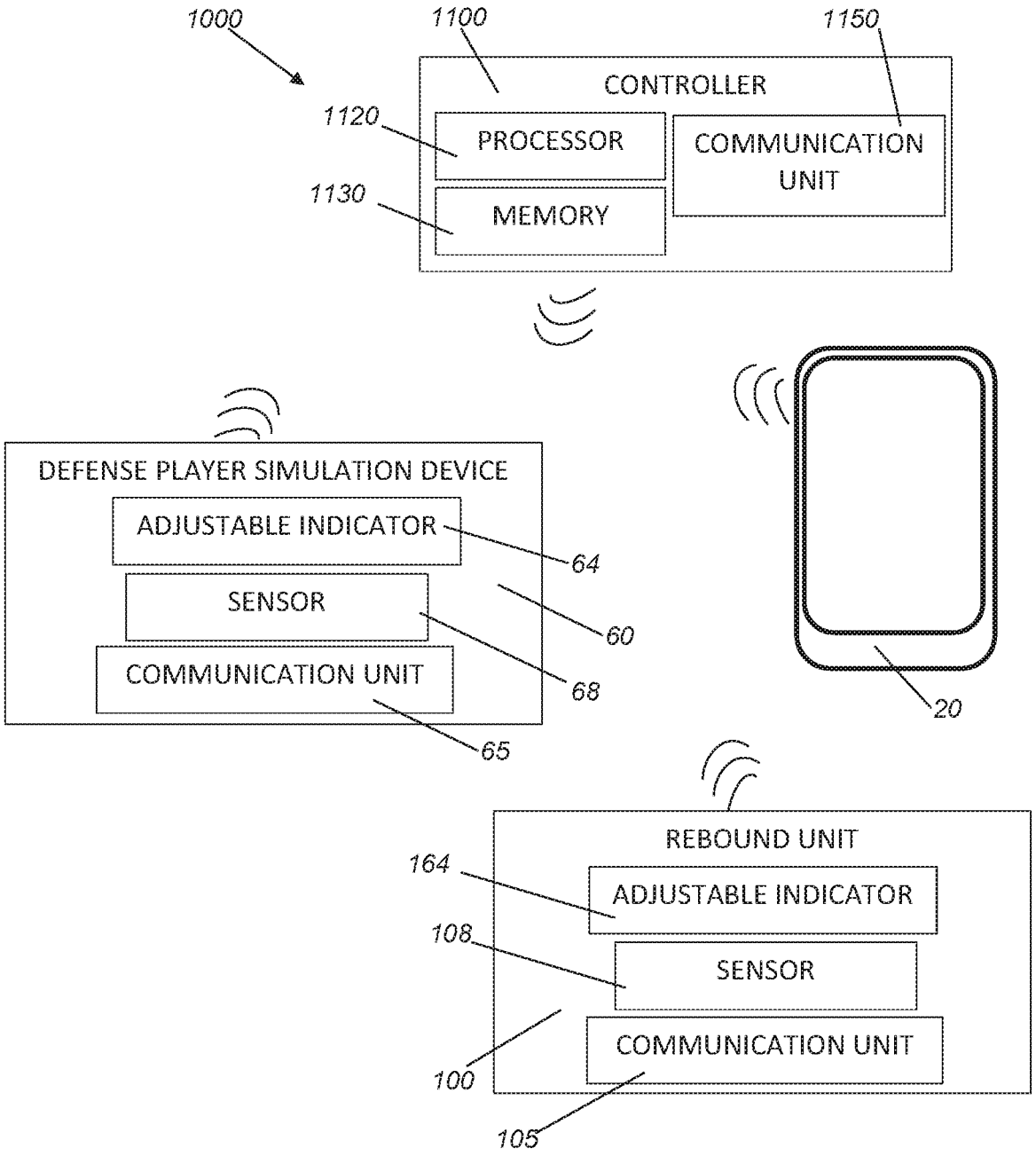
FIG. 14 is a high level block diagram of a soccer training system according to some embodiments of the invention.

In some embodiments, system 1000 may further include a controller as illustrated in FIG. 14. FIG. 14 is a high level block of a soccer training system according to some embodiments of the invention. System 1000 may include at least one rebound unit 100 (e.g., a rebound unit that may or may not include a tunnel 140), one or more defense player simulation devices 60 (and/or nay one of devices 70, 80, 90 and 91) and a controller 1100 configured to control at least some of the controllable components of system 1000. In some embodiments, controller 1100 and/or at least some of the controllable components (e.g., the sensors, adjustable indicators, user interfaces and the like) of system 1000 may be in communication with and/or controlled (e g, managed) by a processor of mobile device 20. Mobile device 20 may be a smartphone, a smartwatch, a tablet, a laptop or any other computing or communication portable device.

In some embodiments, the controllable components of system 1000 may communicate with each other, with controller 1100 and/or with mobile device 20 using any know wireless communication protocol. In some embodiments, a communication unit 1150 may be included in controller 1100 to wirelessly communicate with: mobile device 20, a communication unit 65 included in defense player simulation device 60 and/or with a communication unit 105 included in rebound unit 100.

Controller 1100 may include a processor 1120 being any processing or computing platform, for example, a CPU, a cloud based computing service and the like. Controller 1100 may further include a memory 1130 for storing thereon instructions to be carried out and executed by processor 1120, for example, instructions for controlling a soccer training system according to some embodiments of the invention.

In some embodiments, both adjustable indicator 64 and sensor 68 of defense player simulation device 60 may be in communication with and/or controlled by processor 1120 and/or the processor of mobile device 20.

In some embodiments, rebound unit 100 may further include at least one adjustable indicator 164. Adjustable indicator 164 may include any adjustable indicator (e.g., screen, sign, signal, marking, sound indicator and the like) to provide the game instructions to a user. Adjustable indicator 164 may be detachably connected to base 110, illustrated in FIGS. 1 and 2, or may be included in base 110, for example, a screen embedded in one of the sides of base 110. Adjustable indicator 164 may be controlled manually (e.g., by a coach) or automatically by processor 1120 and/or the processor of mobile device 20. In some embodiments, both adjustable indicator 164 and one or more sensors 108 and 180 of rebound unit 100 may be in communication with and/or controlled by processor 1120 and/or the processor of mobile device 20.

Figure 15:
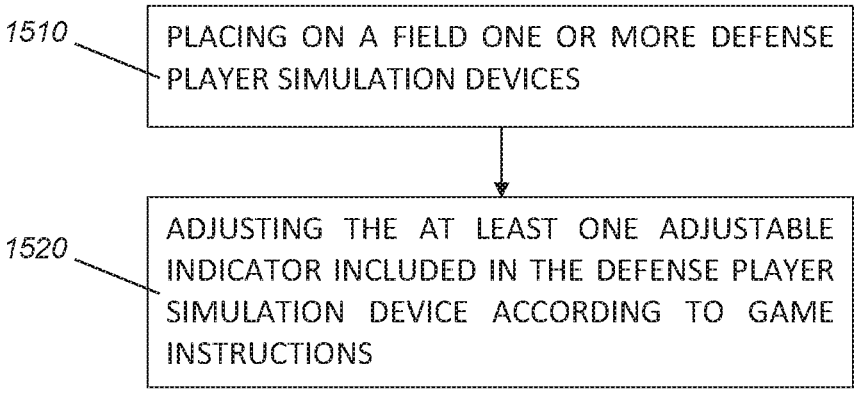
FIG. 15 is a flowchart of a method of training a soccer player according to some embodiments of the invention.

Reference is now made to FIG. 15 which is a flowchart of a method of training a soccer player according to some embodiments of the invention. In some embodiments, one or more defense player simulation devices (e.g., devices 60, 70, 80, 90 and 91) may be placed on a field, in step 1510, for example, by the player or the coach. The player or the coach may place the defense player simulation devices at locations determined according to a training program.

In some embodiments, one or more adjustable indicators included in the one or more defense player simulation devices may be adjusted according to game instructions, in step 1520. For example, the coach or the player may shift an arrow to mark from which side to pass the simulation devices or which foot to use for kicking the ball. In another example, the coach or the player may mark by coloring or lighting a portion of the simulation devices indicating with part of the shoe to use for kicking the ball (as illustrated in FIGS. 6-8 and 10). In yet another example, the coach or the player may use an application running on a mobile device to remotely adjust the one or more adjustable indicators. In some embodiments, the application may include on option for selecting an order of operation of two or more simulation devices and the adjustable indicators the two or more simulation devices may be lit/operated according to the selected order. It should be appreciated by those skilled in the art that once a player has completed the required task in a first location (e.g., passed the first defense player simulation device from the required side, kicked the ball through a tunnel in rebound a unit, etc.), the next required task may be indicated by one or more indicators located on the same or another device. According to some embodiments, determining that a task has been completed may be by a coach or a player, or by the processor, based on input received from one or more sensors.

Figure 16:
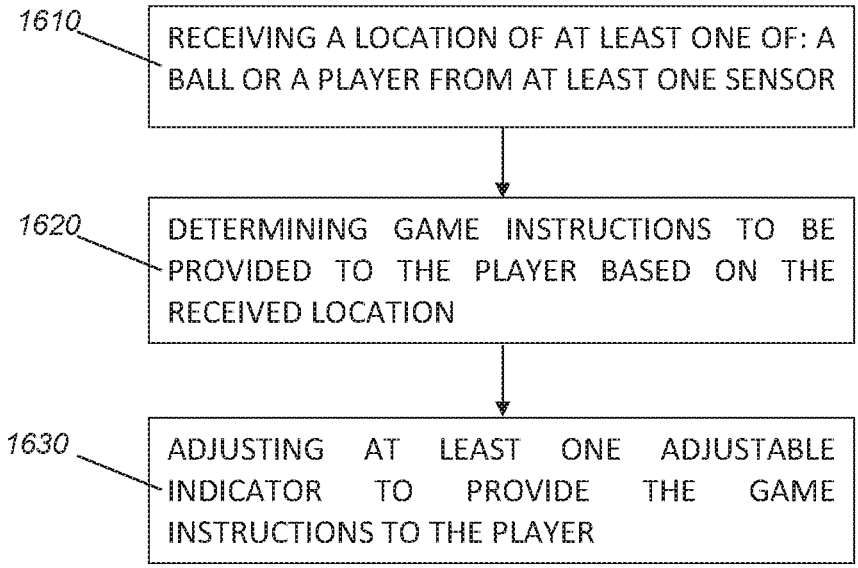
FIG. 16 is a flowchart of a method of controlling a soccer training system according to some embodiments of the invention.

Reference is now made to FIG. 16 which is a flowchart of a method of controlling a soccer training system according to some embodiments of the invention. The method of FIG. 16 may be executed by processor 1120 and/or by the processor of mobile device 20 or by any other processor. A location of at least one of: a ball or a player may be received from at least one sensor (e.g., sensor 68, 108 or 180) located on at least one of: a rebound unit (e.g., unit 100 or 200) and one or more defense player simulation devices (e.g., 60, 70, 80, 90 and 91) included in the training system, in step 1610. In some embodiments, game instructions may be determined to be provided to the player based on the received location, in step 1620. According to some embodiments, the game instructions may include, from which side of a defense simulation device to pass the ball, from which side of a defense simulation device the player should pass, which leg to use for kicking the ball and which part of the shoe, how many defense player simulation devices the user must pass and at which order, to which direction the ball should be kicked, and the like.

In some embodiments, at least one adjustable indicator (e.g., indicator 64, 74, 84 and 164) located on at least one of: the rebound unit and the one or more defense player simulation devices, may be adjusted to provide the game instructions to the player, in step 1630. The at least one adjustable indicator may be adjusted according to any one of the embodiments disclosed above.

An example of a training session of a soccer player using system 1000 may include: providing an instruction to the player to pass a first defense player simulation device 60 from the left, by adjusting a first adjustable indicator 64. A first sensor 68 attached to first defense player simulation device 60 may send controller 1100 an indication that the player successfully preformed the task. In some embodiments, controller 1100 may control a second defense player simulation device 60 to present the player instructions to pass the second simulation device 60 from the left while kicking the ball with the right side of the shoe, by adjusting a second adjustable indicator 64. A second sensor 68 attached to second defense player simulation device 60 may send controller 1100 an indication that the player failed to preformed the task. Controller 1100 may present to the player, on a user device, a score (e.g., 50%) for completing only ½ of the task and/or presenting the player with additional instructions, using for example, the adjustable indicators 64 on the first and second simulation devices 60.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A soccer training system, comprising:
one or more rebound units, comprising:
a base;
at least one rebound surface and
at least one tunnel having a tunnel inlet and a tunnel outlet, the tunnel has a cross section larger than a soccer ball,
wherein the shape of the tunnel is such that when the base is placed on the ground a soccer ball entering the inlet is directed towards the outlet;
at least one sensor for detecting a ball location; and
a processor configured to:
receive a real location of the ball from the sensor;
determine game instructions based on the received location;
provide the game instruction;
receive from the sensor a second actual location on the rebound unit at which the ball engaged the rebound unit;
calculate user performance level based one the distance between the second required location and the second actual location; and
present the calculated performance level via the user interface.

2. The soccer training system of claim 1, wherein the real location of the ball is a first actual location on the rebound unit at which the ball engaged the rebound unit and wherein the processor is configured to:
determine a second required location on the rebound unit at which the ball should engage the rebound unit; and
presenting the second required location via a user interface.

3. The soccer training system of claim 1, further comprising: one or more indicator to present instructions to a user.

4. The soccer training system of claim 3, wherein the one or more indicators are detachably connected to at least one of the inlet, the outlet, and one or more locations on the rebound surface.

5. The soccer training system of claim 1, further comprising:
one or more defense player simulation devices, comprising:
a stable body to be placed on a field; and
at least one adjustable indicator located on the stable body,
wherein in operation the at least one adjustable indicator is configured to provide game instructions to a user,
and wherein the processor is further configured to control the at least one adjustable indicator to provide the game instructions to the user.

6. The soccer training system of claim 1, wherein at least one sensor is attached to one of the rebound units.

7. The soccer training system of claim 5,
wherein at least one sensor is attached to the at least one of the defense player simulation devices and configured to detect at least one of: the user and the ball, and
wherein the processor is further configured to:
receive from the sensor real location of at least one of: the user and the ball; and
determine the game instructions based on the received real location.

8. The soccer training system of claim 1, wherein the at least one sensor is selected from a group consisting of: a camera, a motion sensor, a volumetric sensor, a piezoelectric sensor, a Near Field Communication device (NFC).

9. The soccer training system of claim 1, wherein the tunnel comprises an adjustable directing element configured to set the exit direction from the tunnel.

10. The soccer training system of claim 9, wherein the directing element comprises an adjustable rotating wing.

11. The soccer training system of claim 9, wherein the directing element has a concaved shape.

12. The soccer training system of claim 1, comprising a connector to connect to at least one additional rebound unit.

13. The soccer training system of claim 1, wherein one or more of the at least one rebound surface is concaved.

14. The soccer training system of claim 1, wherein one or more of the at least one rebound surface is convex.

15. The soccer training system of claim 5, wherein the instructions provided by at least one adjustable indicator comprises instructions relating to one of: part of shoe to use, which foot to use, and from which side to pass the defense player simulation device.

16. The soccer training system of claim 5, wherein the at least one adjustable indicator is detachably connected to the simulation device.

17. A method of controlling a soccer training system, comprising:

receiving a location of at least one of: a ball or a player from at least one sensor located on at least one of: a rebound unit and one or more defense player simulation devices included in the training system;

determining game instructions to be provided to the player based on the received location; and adjusting at least one adjustable indicator located on at least one of: the rebound unit and the one or more defense player simulation devices, to provide the game instructions to the player, wherein the rebound unit comprises:

a base;

at least one rebound surface and at least one tunnel having a tunnel inlet and a tunnel outlet, the tunnel has a cross section larger than a soccer ball, wherein the shape of the tunnel is such that when the base is placed on the ground a soccer ball entering the inlet is directed towards the outlet; and wherein the one or more defense player simulation devices, comprises:

a stable body to be placed on a field; and at least one adjustable indicator located on the stable body.

* * * * *